United States Patent [19]

Griffin et al.

[11] Patent Number: 4,488,131

[45] Date of Patent: Dec. 11, 1984

[54] MIC DUAL MODE RING RESONATOR FILTER

[75] Inventors: Edward L. Griffin, Roanoke, Va.; Harvey M. Endler, Chatsworth; Frederick A. Young, Huntington Beach, both of Calif.

[73] Assignee: Hughes Aircraft Company, El Segundo, Calif.

[21] Appl. No.: 469,615

[22] Filed: Feb. 25, 1983

[51] Int. Cl.[3] ..... H01P 7/08

[52] U.S. Cl. ..... 333/205; 333/219; 333/235

[58] Field of Search ..... 333/202, 204, 205, 219-224, 333/235, 245, 246

[56] References Cited

PUBLICATIONS

Wolff-"Microstrip Bandpass Filter Using Degenerate Modes of a Microstrip Ring Resonator", Electronics Letters, (Jun. 15, 1972), vol. 8, No. 12; pp. 302-303.

*Primary Examiner*—Marvin L. Nussbaum

*Attorney, Agent, or Firm*—C. L. Anderson; W. J. Benman, Jr.; A. W. Karambelas

[57] ABSTRACT

An electromagnetic filter assembly comprises a transmission line electromagnetically coupled to a dual mode resonator having a means for differentially tuning the two modes. The filter may be incorporated in a microwave integrated circuit, and the tuning means may be a movable dielectric slab asymmetrically disposed on the resonator.

4 Claims, 2 Drawing Figures

MIC DUAL MODE RING RESONATOR FILTER

BACKGROUND OF THE INVENTION

The present invention relates to electromagnetic filters, and more particularly to a microwave integated circuit filter.

At microwave frequencies, as at other frequencies, filters are used to select or reject bands of electromagnetic frequencies. For example, the information sought to be received is usually within a specified frequency range, and it is desirable to filter out extraneous frequencies which might otherwise appear as "noise" when the signals are decoded, or otherwise transformed. The effectiveness of a filter often depends on the effectiveness with which it rejects out-of-band frequencies.

One microstrip filter is disclosed in "Microstrip Bandpass Filter Using Degenerate Modes of a Microstrip Ring Resonator", by I. Wolff, *Electronic Letter,* June 15, 1972, Vol. 8, No. 12. Wolff indicates that two degenerate modes can be coupled if the symmetry of a resonator is disturbed. Wolff achieves asymmetry in two ways. In the first, one transmission line is directed obliquely to a second transmission line, both lines being coupled to the intermediate resonator element in a bandpass filter. In the second, a notch is cut into the resonator which differentially affects the two resonance modes. However, Wolff's arrangement does not provide clear practical advantages over available filters.

SUMMARY OF THE INVENTION

An improved microwave integrated circuit (MIC) filter includes a tunable dual mode resonator. An assembly incorporating the filter includes a transmission line for electromagnetic waves spaced from the resonator, which may be a closed loop. Means are provided for differentially tuning the two resonance modes.

In one aspect of the present invention, a microwave circuit includes a dielectric base, a conductor on one side of the base defining a ground plane, and the transmission line and resonator on the opposite side of the base. The resonator may be square and have two sides parallel to the transmission line. One orthogonal side may have a dielectric slab which can be moved so as to differentially tune the two resonance modes. In operation, the tuning means is used to make the filtered frequencies coincide. The filter, so tuned, rejects unwanted frequencies far more effectively than comparable filters.

DETAILED DESCRIPTION OF THE INVENTION

Figure 1:
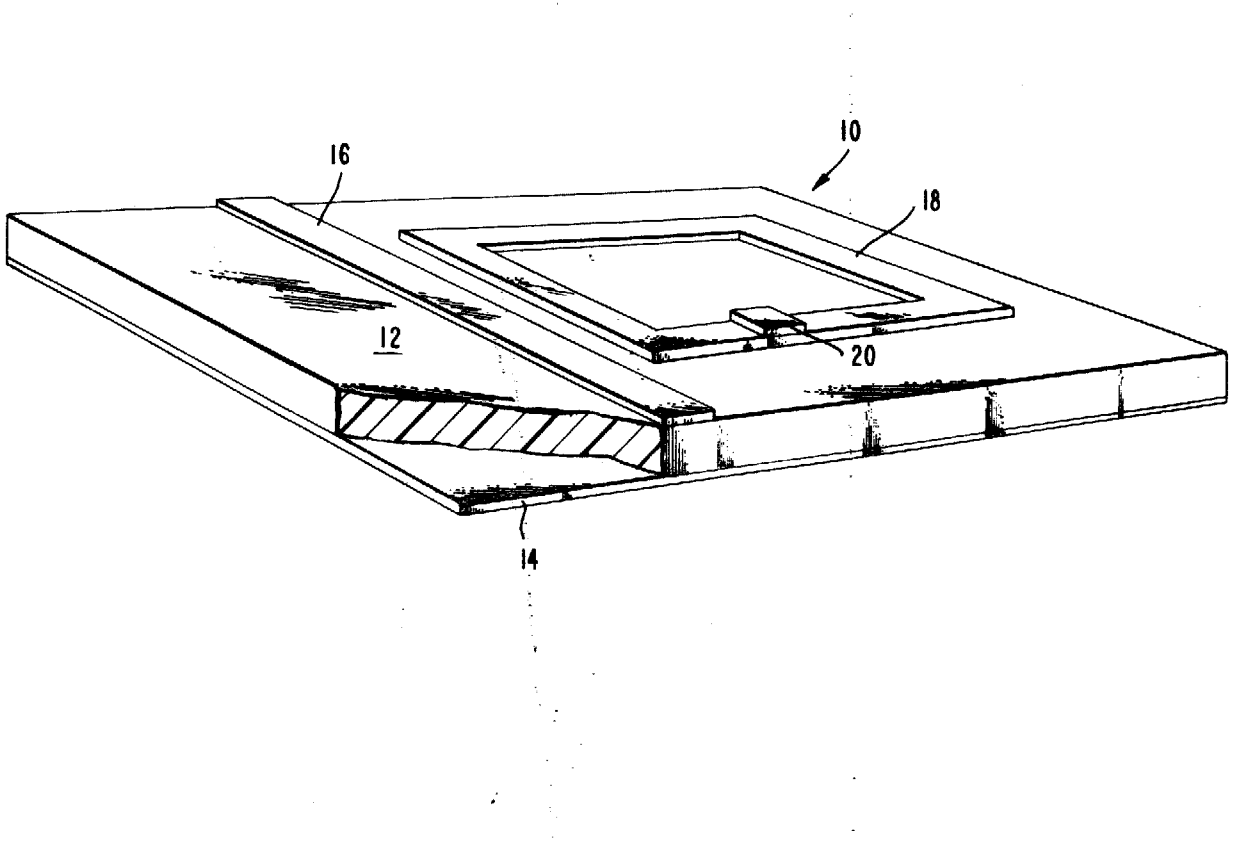
FIG. 1 is a diagrammatic view of a filter in accordance with the present invention.

In accordance with the present invention, a filter 10, shown in FIG. 1, includes a dielectric base 12, a conductor 14 on one side defining a ground plane 15, and a transmission line 16 and a resonator 18 on the other side. The resonator 18 is a dual mode type in that two independent standing waves can coexist within. A dielectric slab 20 is provided as a means for differentially tuning the two modes.

The base 12 is of dielectric material and acts as a primary medium for electromagnetic energy, as well as the structural foundation of the circuit 10. The transmission line 16 is printed on the side of the base 12 opposite the ground plane 15.

The illustrated filter 10 is a notch filter, which means it subtracts a frequency band from the transmitted band. Alternatively, the invention could be used to provide a band pass filter. The illustrated resonator 18 is square, with sides of L/4, where L is the wavelength to be filtered. More generally, the resonator 18 filters out waves of wavelength nL/4, where n is a positive integer.

While other resonator shapes are admitted by the present invention, the square provides good coupling with the straight transmission line 16 and readily calculable resonance effects.

The dielectric slab 20 is placed on one of the square's sides which are perpendicular to the transmission line 16. Generally, the dielectric slab 20 differentially affects the two modes. By moving the dielectric slab 20, the modes can be differentially tuned so that the peak filtered frequencies coincide.

Figure 2:
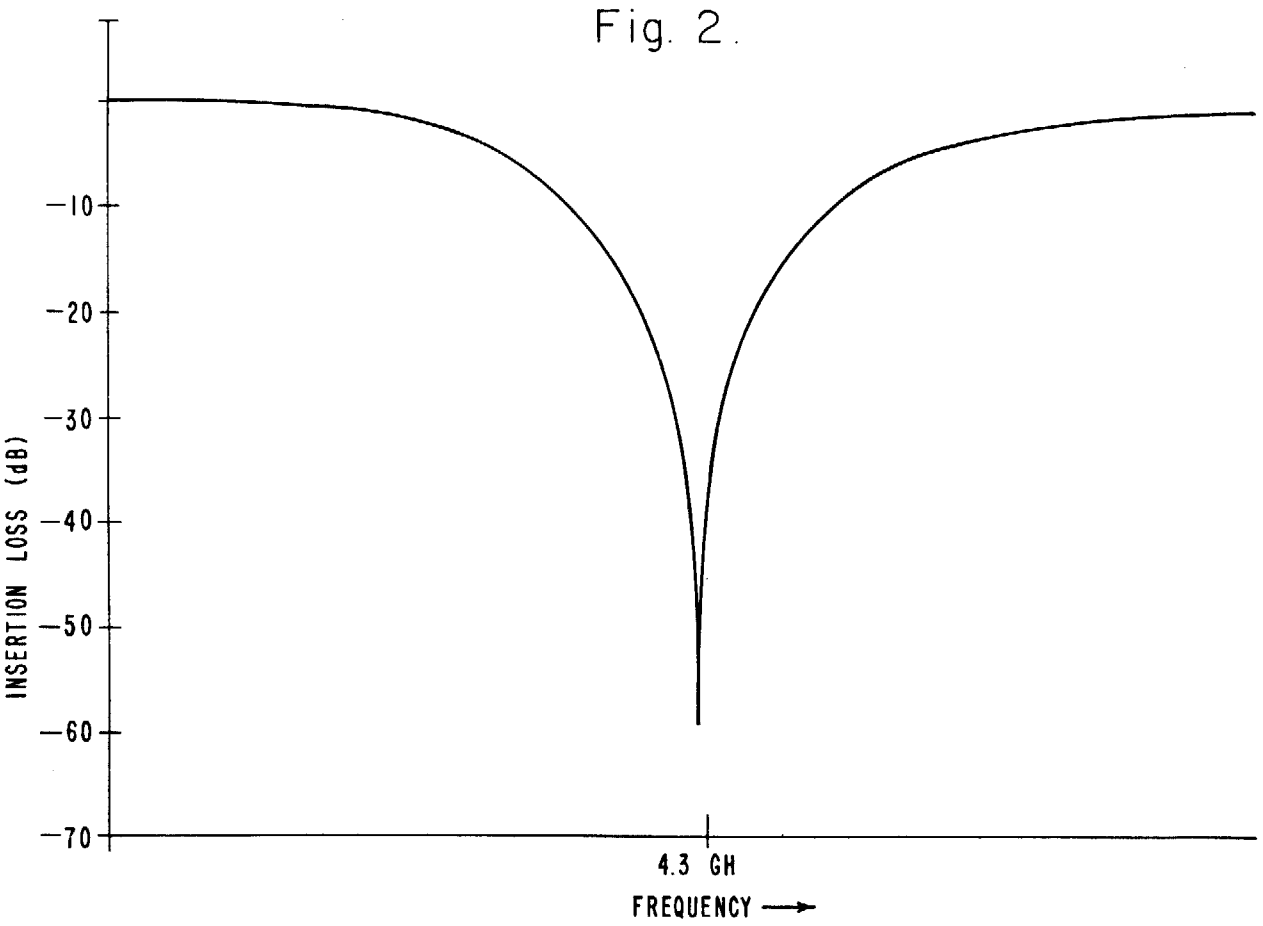
FIG. 2 is a graph illustrating the performance of the device of FIG. 1.

The performance of the preferred embodiment is indicated in FIG. 2. Electromagnetic energy of uniform amplitude in a bandwidth about 4.3 GHz is transmitted along the first section of the transmission line 16. FIG. 2 indicates the transmission output. The notch indicates the frequencies filtered from the input.

Very sharp rejection is a primary design objective of a MIC filter. The "quality", $Q_u$, is a measure of the sharpness for the respective notch pattern. More specifically, $Q_u$ is the breadth of the notch at the half power level divided by the frequency at which the greatest depth of the notch occurs. Stated algebraically, $$Q_u = f_0/(f_2 - f_1)$$

where, $f_0$ is the frequency at which maximum rejection occurs, $f_1$ is the frequency less than $f_0$ where the rejection is half that at $f_0$, and $f_2$ is the frequency greater than $f_0$ at which the rejection is half that at $f_0$.

Applying this formula, the $Q_u$ for the illustrated filter has been about 1400. This represents a considerable improvement over available filter. For example, half wave filters, for which no even-odd mode effects occur, exhibit a $Q_u$ around 200.

During operation of the filter 10, a band of frequencies about 4.3 GHz are transmitted along the transmission line 16. The associated wavelength is 1.14 cm. Thus the resonator 18 is one fourth 1.14 cm, or 0.29 cm per side. In the illustrated embodiment, the resonator 18 is spaced 0.177 cm from the transmission line 16.

When the frequency band is transmitted along the transmission line 16, the resonator 18 resonates in two modes, each mode resulting in the rejection of part of the frequency band. In general, the characteristic peak frequency selected by each mode will be close, but not coincidental. The performance of the dual mode resonator 18 in such a circumstance is on the order of two half wave resonators, each operating at a respective mode.

However, the inclusion of the movable dielectric slab 20 permits differential tuning of the two modes. The dielectric slab 20 in the resonator 18 results in a greater effective path length for the enclosed electromagnetic waves. The amount of the increase is dependent on a complex of factors which vary according to the position of the dielectric relative to the pattern of the standing wave of either mode. For example, the path lengthening effect is normally greater when the dielectric is located at a maximum as opposed to a node in the respective standing wave.

By moving the dielectric slab 20, the two modes are differentially tuned. Thus, offset peaks can be made to coincide so as to provide better definition to the filtering.

It is apparent that many modifications on the described embodiments are possible. Different forms and dimensions are available for the transmission line and resonator. The resonator may have more than two modes. The filter may be a bandpass or a notch filter. The tuning means may be altered. These and other variations and alternatives are within the scope of the present invention.

What is claimed is:

1. A microwave integrated circuit electromagnetic filter assembly comprising:

a transmission line adapted to transmitting electromagnetic waves within a predetermined frequency band;

a resonator electromagnetically coupled to said transmission line so that electromagnetic transmissions along said transmission line can induce resonance in least two modes, said resonator defining a closed electromagnetic path; and tuning means associated with said resonator for differentially tuning the two modes.

2. A microwave integrated circuit comprising:

a transmission line adapted to transmitting electromagnetic waves within a predetermined frequency band;

a resonator providing a closed path for electromagnetic waves, said resonator being capable of resonating in two modes, said resonator being located on said other surface of said base, said resonator being electromagnetically coupled to said transmission line so that when electromagnetic waves are transmitted along said transmission line, resonances in two modes are established in said resonator; and tuning means associated with said resonator for differentially tuning the two modes.

3. A microwave integrated circuit comprising:

a transmission line adapted to transmitting electromagnetic waves within a predetermined frequency band;

a resonator providing a closed path for electromagnetic waves, said resonator being capable of resonating in two modes, said resonator being located on said other surface of said base, said resonator being electromagnetically coupled to said transmission line so that when electromagnetic waves are transmitted along said transmission line, resonances in two modes are established in said resonator; and tuning means associated with said resonator for differentially tuning the two modes, said tuning means including a dielectric slab which can be moved along the electromagnetic path of said resonator.

4. A microwave integrated circuit comprising:

a dielectric base having two opposing surfaces;

a conducting layer on one of said surfaces;

a linear microwave transmission line on the other of said surfaces;

a square resonator disposed adjacent and with two sides parallel to said transmission line; and a dielectric slab movably positioned along one of the square resonator's sides which is orthogonal to said transmission line.

* * * * *